US006135273A

United States Patent [19]

Cuen

[11] Patent Number: 6,135,273

[45] Date of Patent: Oct. 24, 2000

[54] THERMAL BAG

[76] Inventor: Joseph Anthony Cuen, 140 E. 17th St. Apt 6B, New York, N.Y. 10003

[21] Appl. No.: 09/282,410

[22] Filed: Mar. 31, 1999

[51] Int. Cl.[7] ..... B65D 81/00

[52] U.S. Cl. ..... 206/204; 206/545

[58] Field of Search ..... 206/541, 545, 206/204; 220/902, DIG. 10; 426/112

[56] References Cited

U.S. PATENT DOCUMENTS

| | | | |
|---|---|---|---|
| 4,861,632 | 8/1989 | Caggiano . | |
| 4,892,226 | 1/1990 | Abtahi . | |
| 5,148,613 | 9/1992 | Cullen . | |
| 5,372,429 | 12/1994 | Beaver, Jr. et al. . | |
| 5,450,948 | 9/1995 | Beausoleil et al. | 206/204 |
| 5,664,899 | 9/1997 | Truesdale | 206/204 X |
| 5,706,937 | 1/1998 | Futagawa . | |

*Primary Examiner*—Jacob K. Ackun
*Attorney, Agent, or Firm*—Furgang & Adwar, L.L.P.

[57] ABSTRACT

A thermal container designed to contain a food product, medical supplies or other substances during transportation from the place of manufacture to the place of use and to maintain those products at a constant temperature and in a substantially dry environment. The thermal container is equipped with a pouch containing a quantity of a desiccant or a layered shield which contains a quantity of a desiccant. Moisture in the form of steam or condensation resulting from the product is absorbed by the desiccant. A netting affixed to the interior of the thermal container holds the pouch or layered shield which may easily be replaced as the desiccant becomes saturated with water.

12 Claims, 2 Drawing Sheets

THERMAL BAG

FIELD OF THE INVENTION

The instant invention relates to a thermal container of a type used to maintain the temperature of the material contained therein with the addition of a desiccant to absorb moisture produced within the container.

BACKGROUND OF THE INVENTION

There are many types of thermal containers from the common foam-type picnic coolers to sophisticated insulated containers with hermetically sealed covers. When hot materials are placed in such a container, moisture in the form of steam may be given off creating a high humidity environment within the container. If hot food is to be transported in such a thermal container, the steam emitted may cause the food to become soggy or to become otherwise undesirable. A cold material placed in an insulated container may "sweat" causing the materials contained therein and the interior surfaces of the container to become moist and may also alter the characteristics of the materials.

Caggiano, in U.S. Pat. No. 4,861,632, teaches a laminated packaging material that can be use to formulate containers for storing or transporting a variety of products. Sheets of this material can be combined to form bag-type containers. The outer layer of the material is water impervious, the middle layer is a water absorbent substance such as sheets of paper toweling, and the inner layer is water impervious with perforations. Another embodiment of the invention uses paper toweling impregnated with a desiccant as the middle layer and a further embodiment includes a layer of granulated desiccant between layers of paper toweling. The material is designed to absorb any moisture given off by the products placed in the container. These containers are flexible and are not practical for transporting hot or cold foods or other substances which must be kept in rigid containers to maintain their integrity.

Beaver, Jr. et al, in U.S. Pat. No. 5,372,429, teaches a shipping pouch that is made up of three layers. An outer bag contains a filler layer in the form of a compressible absorbent material capable of conforming to the shape of any object that may be placed in an inner bag. Cushioning and absorbent materials such as cellulose, sawdust or wool are suggested as well as several desiccants. This pouch is designed to accommodate irregularly shaped objects that can be broken or otherwise damaged during shipping and is not practical for transporting foods. The pouch is not designed to maintain the temperature fits contents.

The invention of Cullen, U.S. Pat. No. 5,148,613, teaches a covered container used to absorb water from the environment of a closet. The rigid container has a perforated elastic diaphragm suspended from the inside of the cover which holds a quantity of a deliquescent material. There is an opening in the cover over which is stretched a membrane which permits water vapor, but not liquid water to enter the container. The water vapor enters the container through the membrane and is absorbed into the deliquescent material until the solution formed therefrom drips down into the container. As the deliquescent material is used up the elastic diaphragm contracts so as to prevent the solution in the container from making contact with the diaphragm. This container is not geared to contain foods or other materials. It is designed only to remove water from its external environment.

A cosmetic case having a removable refrigerant pack is taught by Abtahi in U.S. Pat. No. 4,892,226. The side walls of the interior of the case are covered with two layers of an material such as foam or a sponge-like material and the frozen pack is placed between these layers so that any condensation that may form on the pack is absorbed and the cosmetics are maintained in a substantially dry condition. The refrigerant pack can be frozen by placement in the freezer compartment of the refrigerator. As the foam absorbs the condensation it becomes wet and the environment within the container remains at a high humidity. This type of container is not useful when the interior of a container is desired to be maintained at low humidity.

Futagawa, in U.S. Pat. No. 5,706,937, teaches a dual pouch for carrying medical mixtures. The upper pouch is designed to contain a dry substance and the lower pouch contains the liquid. A seal between the two pouches is broken when the two substances are to be mixed. The upper pouch has laminated walls which contain a layer of water absorbent material such as a film coated with silica gel on one side and a film containing the inorganic filler DRY-KEEP on the other side. The laminate is designed to intercept moisture and oxygen. This container is flexible, sealed, and prevents moisture from entering the interior. It cannot be readily opened and closed or used to contain a substance that may give off moisture from within the pouch.

Though the prior art describes a variety of containers, none is designed to transport materials that must be maintained at high or low temperatures while at the same time preventing the increase in humidity within the container. Such moisture within a transport container can damage foods and medical supplies. If the container is vented to provide an outlet for the moisture, the temperature cannot be maintained at the desired level. There is a need for a container that can be used to transport hot foods while preventing the food from becoming soggy or otherwise unappetizing. There is also a need for a container that can also be used to keep foods and other materials cold without having condensation dampening the interior of the container to the detriment of its contents.

BRIEF SUMMARY OF THE INVENTION

It is an object of the present invention to provide a thermal container that can be used to maintain foods or other substances at temperatures other than room temperature and to prevent moisture within the container from spoiling the foods or other substances.

It is another object of the present invention to provide a thermal container provided with a moisture absorbing material which can be replaced when it becomes saturated.

It is a further object of the present invention to provide a thermal container with an easy and inexpensive means of moisture removal without affecting the internal temperature of the container.

It is a still further object of the present container to provide a simple method of replacement of the moisture absorbing material.

It is another object of the present invention to provide a portable, thermal, moisture controlling container that has no moving parts and requires no energy source.

Another object of the present invention is to provide an inexpensive and easy to manufacture thermal container capable of maintaining a dry interior atmosphere.

The instant invention is a thermal container of the type used to transport substances in which it is desired to maintain a constant temperature and a substantially dry environment.

The container has a holding means affixed to an interior surface in which is placed a quantity of moisture absorbing material.

A method of maintaining a substance at a constant temperature and in a substantially dry environment. A thermal housing is provided in which there is a holding means affixed to an inside surface. A water absorbing means is placed in the holding means and the substance is placed into the thermal housing. Any moisture released by the substance is absorbed by the water absorbing means.

Other features and advantages of the invention will be seen from the following description of the drawings where similar reference characters are used to designate corresponding parts in all of the views.

DESCRIPTION OF THE PREFERRED EMBODIMENT

Figure 1:
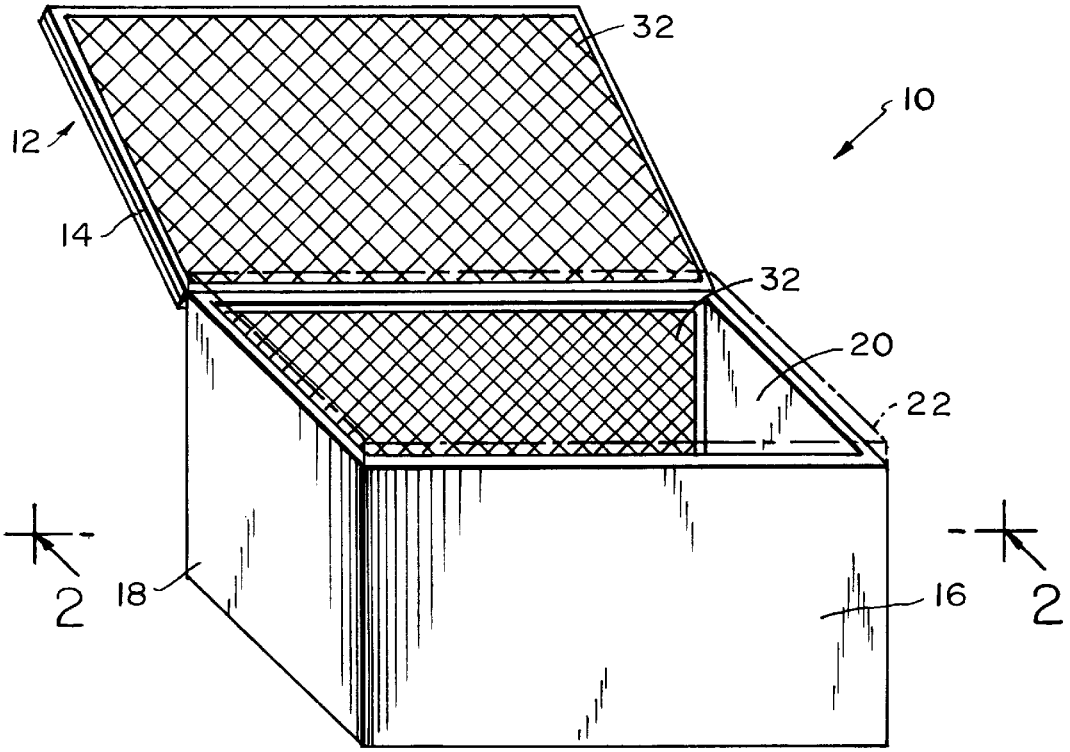
FIG. 1 is a perspective view of one embodiment of the container of the instant invention.

The container 10 of the instant invention FIG. 1 may be preferably intended for use with hot and cold foods and also for medical supplies where maintaining a constant temperature and low humidity are essential. The container 10 may be made of a thermal material such as styrofoam or any other such insulating material or materials, both rigid and flexible, known in the art.

Figure 2:
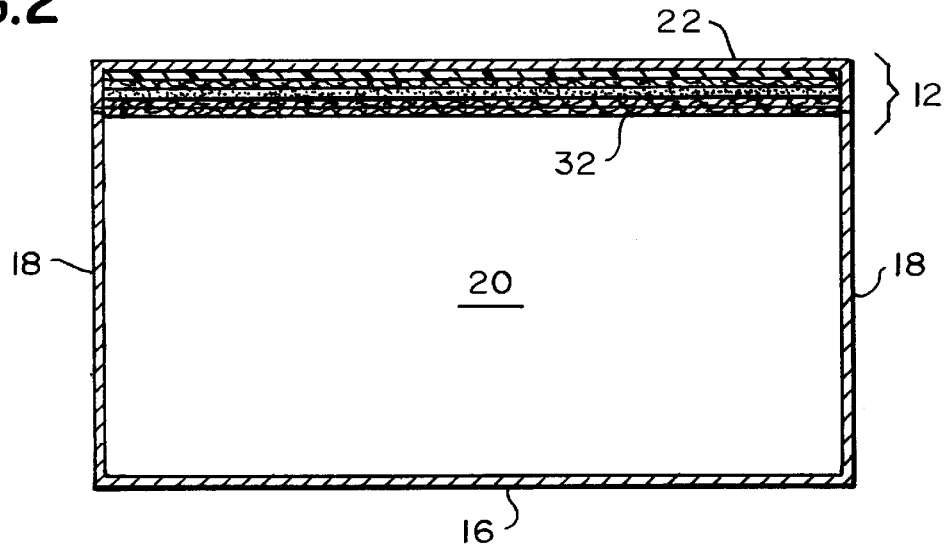
FIG. 2 is a top plan view of the container of FIG. 1.

The container 10 may have a front wall 16, two sidewalls 18, a back wall 22, a bottom (not shown) and a cover 14. In one embodiment of the invention a tight net panel 32 of a non-absorbent material such as nylon may be affixed to the inside of the cover 14. A similar net panel 32 may also be affixed to the inside of the back panel 22 of the container 10 FIGS. 1 and 2. The net panel 32 may function to hold a moisture absorbing shield 12 in place. This shield 12 may be replaced as needed when it can no longer absorb moisture.

Figure 3:
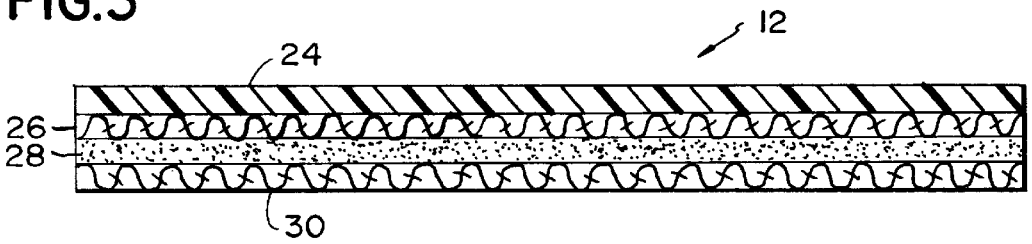
FIG. 3 is a side elevation of the shield of the instant invention.
Figure 4:
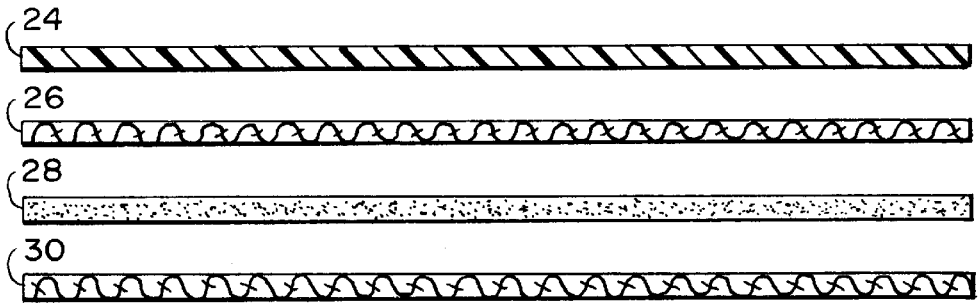
FIG. 4 is an exploded side elevation of the shield of FIG. 3.

The shield 12 may be composed of several layers. The backing or support layer 24 may be a light weight rigid panel made of a plastic or other such rigid, water impervious material FIGS. 3 and 4. The next layer may be a fabric panel 26 over which is disposed a layer of desiccant 28. The fabric panel 26 may be cotton and capable of absorbing moisture, or another fiber that may or may not be absorbent. A permeable fabric panel 30 is placed over the desiccant 28 to hold the desiccant 28 in place and to permit the moisture to penetrate to the desiccant 28. The permeable fabric panel 30 may also be made of cotton or another fabric which permits moisture to pass through.

The use of the net panel 32 as a holder enables the shield 12 to be held firmly in place and to be removed and replaced easily without creating any barrier to the moisture which can easily penetrate the net panel 32. The net panel 32 may be made of nylon or other moisture resistant fiber known in the art. The desiccant 28 may be one of a number of hygroscopic substances well known in the art. One such substance may be silica gel.

Figure 5:
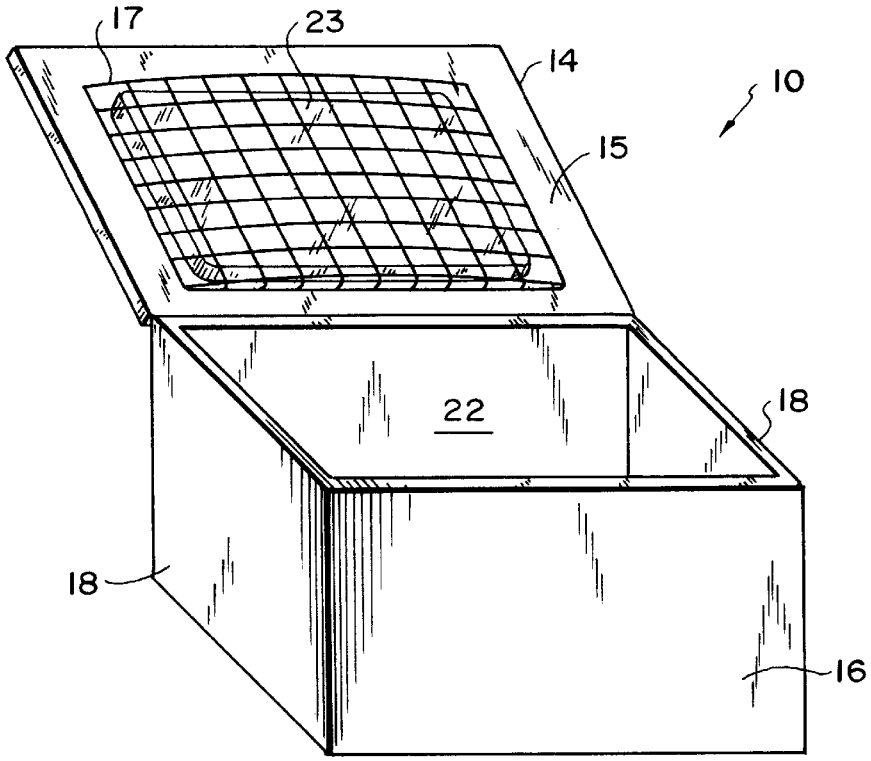
FIG. 5 is a perspective view of another embodiment of the container.

In another embodiment of the invention, a pocket 17, formed by a piece of netting loosely affixed to the inside surface 15 of the cover 14 of the container 10 holds a quantity of desiccant (not shown) or one or more desiccant packets 23 FIG. 5. The desiccant packets 23 can easily be inserted into the pocket 17 and just as easily removed when they are no longer effective. Such packets 23 are well known in the art. The quantity of desiccant used and the type of desiccant may depend upon the volume of the container 10 and the type and quantity of the product placed therein.

The container 10 of the instant invention may be used to transport foods that are hot or cold. Without the moisture absorbing material, condensation or steam generated within the container may settle back on the food making the food soggy and providing an atmosphere amenable to the growth of bacteria. When used to contain medical materials and sterile supplies, the drier the environment the less chance of bacterial contamination.

The thermal container may be made of a rigid material, as illustrated, or it may be made of a semi-rigid or flexible material. The particular material and the shape and dimensions of the container will depend on the type of food or other substance to be transported. The container may be in the form of a box, as illustrated, or a pouch, envelope or bag, all of which may have a net panel affixed to an interior surface to contain the desiccant which may be provided in a pouch, as part of a layered panel as noted above, or in any other form known in the art.

While two embodiments of the instant invention have been illustrated and described in detail, it is to be understood that this invention is not limited thereto and may be otherwise practiced within the scope of the following claims.

What is claimed is:

1. A thermal container of the type used for transport and storage of substances in which it is desired to maintain constant interior temperature and a substantially dry environment, said container comprising:

housing means for containing a substance and maintaining said substance at a particular temperature;

moisture absorbing means within said housing means for maintaining the substantially dry environment; and holding means secured to an interior surface of said housing means for releaseably holding said moisture absorbing means.

2. A thermal container as in claim 1 wherein said moisture absorbing means comprises a water permeable pouch filled with a desiccant.

3. A thermal container as in claim 1 wherein said moisture absorbing means comprises a layered shield, one of said layers being a desiccant.

4. A thermal container as in claim 3 wherein said layered shield comprises a rigid panel, a desiccant and a retaining layer.

5. A thermal container as in claim 4 wherein said layered shield further comprises a fabric layer situated between said rigid panel and said desiccant.

6. A thermal container as in claim 5 wherein said fabric layer is absorbent.

7. A thermal container as in claim 1 wherein said holding means comprises a net panel.

8. A thermal container as in claim 1 in which said housing means has rigid walls.

9. A thermal container as in claim 1 in which said housing means has flexible walls.

10. A thermal container as in claim 1 in said housing a defined by a rectangular cross-section.

11. A thermal container as in claim 1 in the shape of an envelope.

12. A thermal container as in claim 1 in the shape of a pouch.

* * * * *